US010463952B2

(12) United States Patent
Read

(10) Patent No.: US 10,463,952 B2
(45) Date of Patent: Nov. 5, 2019

(54) CUSTOMIZABLE DICE

(71) Applicant: Owen F. Read, Jackson, WY (US)

(72) Inventor: Owen F. Read, Jackson, WY (US)

( * ) Notice: Subject to any disclaimer, the term of this patent is extended or adjusted under 35 U.S.C. 154(b) by 0 days.

(21) Appl. No.: 15/982,682

(22) Filed: May 17, 2018

(65) Prior Publication Data

US 2018/0333638 A1 Nov. 22, 2018

Related U.S. Application Data

(60) Provisional application No. 62/507,639, filed on May 17, 2017.

(51) Int. Cl.

| | |
|---|---|
| ***A63F 9/04*** | (2006.01) |
| ***G07C 15/00*** | (2006.01) |
| *A63F 9/24* | (2006.01) |

(52) U.S. Cl.

CPC ..... *A63F 9/0468* (2013.01); *G07C 15/008* (2013.01); *A63F 9/0415* (2013.01); *A63F 2009/0422* (2013.01); *A63F 2009/0437* (2013.01); *A63F 2009/0488* (2013.01); *A63F 2009/0491* (2013.01); *A63F 2009/2442* (2013.01); *A63F 2009/2444* (2013.01); *A63F 2009/2458* (2013.01)

(58) Field of Classification Search

CPC .... A63F 9/0468; A63F 9/0415; G07C 15/008
See application file for complete search history.

(56) References Cited

U.S. PATENT DOCUMENTS

| | | | | |
|---|---|---|---|---|
| 2,452,730 A | | 11/1948 | Carter | |
| 3,119,621 A | | 1/1964 | Bookman | |
| 3,168,315 A | | 2/1965 | Bookman | |
| 4,034,988 A | | 7/1977 | Goldner et al. | |
| 4,506,890 A | | 3/1985 | Murry | |
| 4,858,930 A | | 8/1989 | McKechnie | |
| 6,331,145 B1 | * | 12/2001 | Sity | A63F 9/0468 273/138.2 |
| 6,394,903 B1 | | 5/2002 | Lam | |
| 7,334,791 B2 | | 2/2008 | Lindsey et al. | |
| 8,662,995 B2 | * | 3/2014 | Hawkins | A63F 9/04 463/22 |
| 9,155,958 B2 | | 10/2015 | Zylkin | |
| 2004/0036213 A1 | * | 2/2004 | Lindsey | A63F 9/0468 273/146 |
| 2005/0159202 A1 | | 7/2005 | Colin et al. | |
| 2017/0007917 A1 | * | 1/2017 | Back | A63F 9/24 |

FOREIGN PATENT DOCUMENTS

| | | | | |
|---|---|---|---|---|
| CA | 2717546 A1 | | 9/2009 | |
| DE | 2726145 A1 | | 12/1978 | |
| DE | 19702012 A1 | | 7/1998 | |
| DE | 102008044201 B4 | * | 11/2011 | A63F 7/048 |
| EP | 2249933 B1 | | 4/2013 | |
| WO | 9911344 | | 3/1999 | |
| WO | 2005072841 A1 | | 8/2005 | |

* cited by examiner

*Primary Examiner* — Jasson H Yoo
(74) *Attorney, Agent, or Firm* — Dobbin IP Law P.C.; Geoffrey E. Dobbin

(57) ABSTRACT

A programmable die may feature a robust frame structure housing a plurality of display screens which may be programmed to display any number of possible data. Any number of sides are possible, so long as they can be read. The die may be programmed remotely, such as through an app, or manually. The displays may be LCD screens or electronic paper, or any later discovered and suitable device. A battery may be directly or inductively charged.

10 Claims, 7 Drawing Sheets

CUSTOMIZABLE DICE

CROSS-REFERENCES TO RELATED APPLICATIONS

This Application claims priority as a non-provisional perfection of prior filed U.S. App. No. 62/507,639, filed May 17, 2017, and incorporates the same by reference in its entirety.

FIELD OF THE INVENTION

The present invention relates to the field of dice and other chance indicators and more particularly relates to an electronic programmable die which may be customized by a user.

BACKGROUND OF THE INVENTION

Dice represent what is perhaps the oldest game of chance in human history. Dice have been found in ancient archeological digs and many civilizations have writings which reference their use in games of chance. It is believed that the earliest forms of dice were marked animal knuckles. The common six-sided cubic die has been found in ancient Roman ruins, complete with 1-6 pips on each side.

Modern uses of dice tend to focus on games of chance, whether rolling a set of dice to achieve a particular score or number or using dice to simulate activities in a role-playing game. Particularly in role-playing games, many different shapes of dice may be utilized—the most common being the d20 system originated by Wizards of the West Coast in the 1970's and licensed as an open gaming system since the early 2000's. The d20 system typically utilizes 4, 6, 8, 10, 12, and 20-sided dies to simulate actions and their chances of success. Many other types of dies may be used, ranging from a two-sided die (essentially a coin) to 100 or more sides.

Another cultural use of a die has been the "Magic 8-ball" by Mattel, Inc. The ball, made in varying diameters and colors and usually marked with an "8" so as to resemble the number 8 billiards ball, is hollow and filled with alcohol, usually dyed blue. Inside is a floating 20-sided die with a saying that would indicate either yes, no, maybe, or try again. A viewer is provided on one side. The game is an approximation of a fortune teller, where a user asks a yes or no question, flips the 8-ball around and the 20-sided die floats until it rests against the viewer so that the user may then read the "answer" from the 8-ball.

However, every die suffers from the same drawback, they are set in what they display. While this is fine if one is just rolling for numbers, it does not account for using a die for random decisions. A user would have to assign a result or representation to whatever die face he or she found suitable. What is needed is a customizable dice experience where the user could determine what each face of the die represented.

The present invention is a die which utilizes a central processing unit ("CPU") and graphical displays to present a user programmable and customizable die. The present invention represents a departure from the prior art in that the die of the present invention allows for user customization of the display on each face of the die, be it a number, color, phrase, graphic, or whatever the user may desire.

SUMMARY OF THE INVENTION

In view of the foregoing disadvantages inherent in the known types of dice, an improved die may provide a die that meets the following objectives: easily programmed and utilized, easily read, rugged enough to withstand repeated throws, and easily stowed. As such, a new and improved die may comprise a die frame which may be of any suitable shape, with sides numbering two to infinity. It should be noted, though, that more sides create smaller faces, which are then harder to distinguish from each other or program. The faces are small display monitors, which may be LCD or electronic paper or any other suitable technology, attached to the internal processor, within the die frame, which may then modify the display screen to reflect any possible outcome the user may conceive. A charging port or induction charging system would be required, or the die may have to be openable to access a battery. The die may be programmable via wireless communication with a device, such as a smartphone or computer, or by direct manipulation of provided controls.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, a preferred embodiment of the user programmable die is herein described. It should be noted that the articles "a", "an", and "the", as used in this specification, include plural referents unless the content clearly dictates otherwise.

Figure 1:
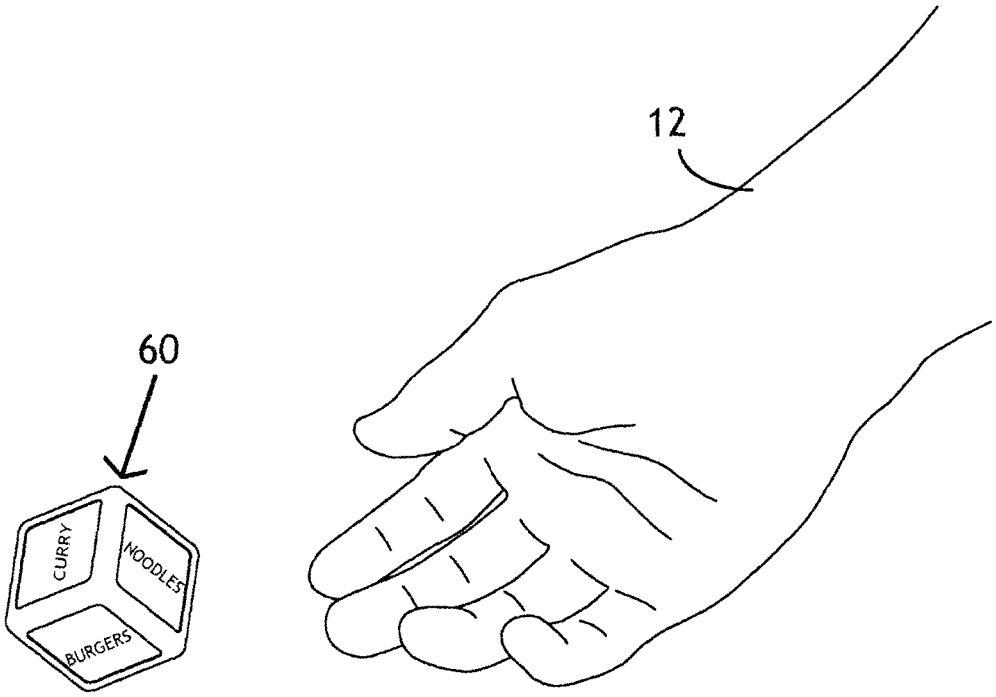
FIG. 1 is a perspective view of a 6-sided die in use.
Figure 2:
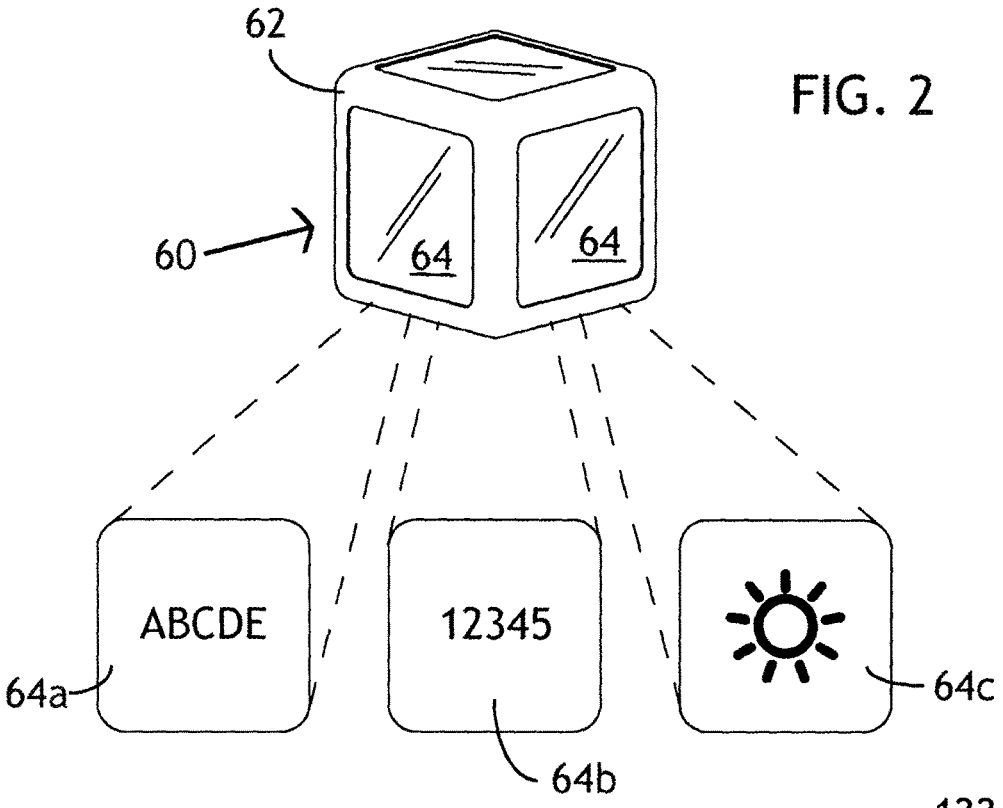
FIG. 2 is a perspective view of a 6-sided die, detailing diverse types of usable information.
Figure 3:
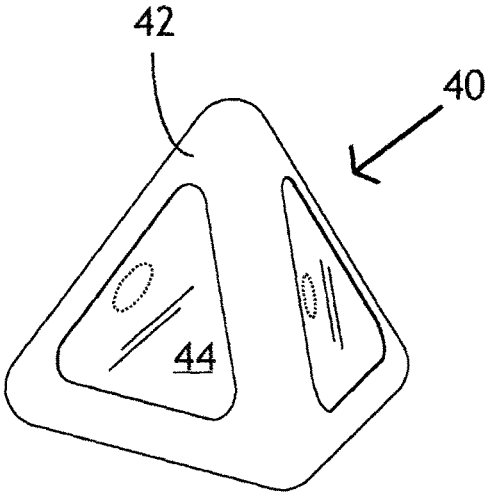
FIG. 3 is a perspective view of a 4-sided die.
Figure 4:
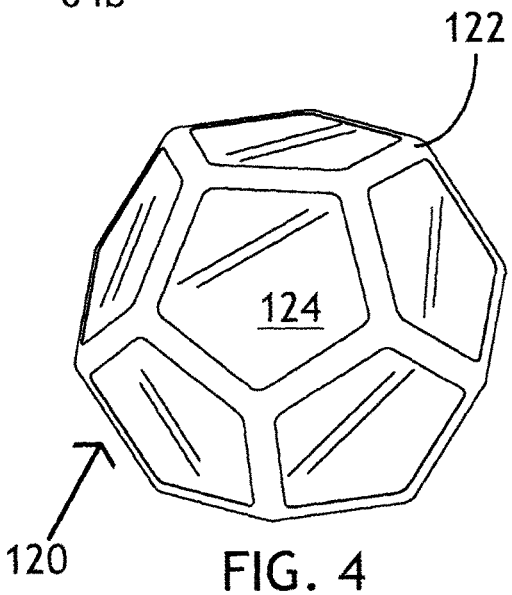
FIG. 4 is a perspective view of a 12-sided die.
Figure 5:
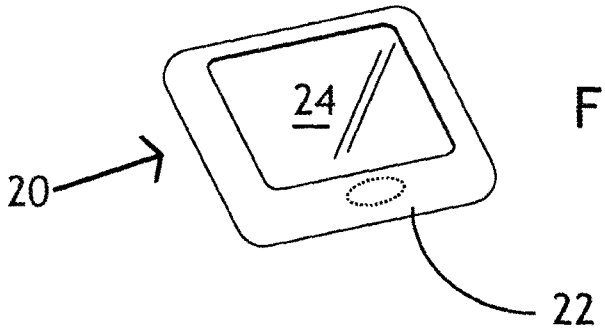
FIG. 5 is a perspective view of a 2-sided die (coin).

With reference to FIG. 1, a die 60 may be rolled by a user 12 to generate a random determination, such as a type of restaurant at which to eat, as is illustrated. Each die 60 features a roll cage 62 with individual display windows 64 therein (FIG. 2). The display windows may display any number of characters 64*a*, numbers 64*b*, or graphics/colors 64*c* as a user may desire. It should be noted that different shapes of dies are possible (FIGS. 3-5), including but not limited to 4-sided (FIG. 3), 12-sided (FIG. 4) and 2-sided, or a coin, (FIG. 5). Each one features its own shape of roll cage, 42, 122, 22, and its own shape and number of display windows 44, 124, 24.

Figure 6:
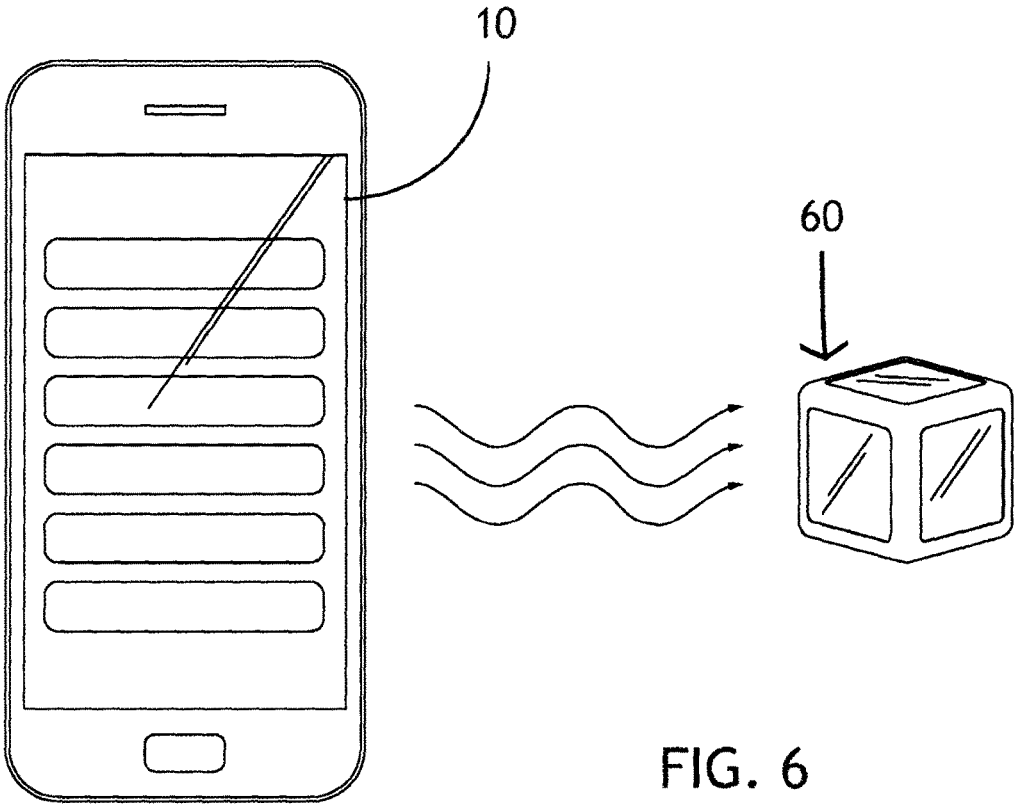
FIG. 6 is a perspective view of a 6-sided die, being programmed.
Figure 7:
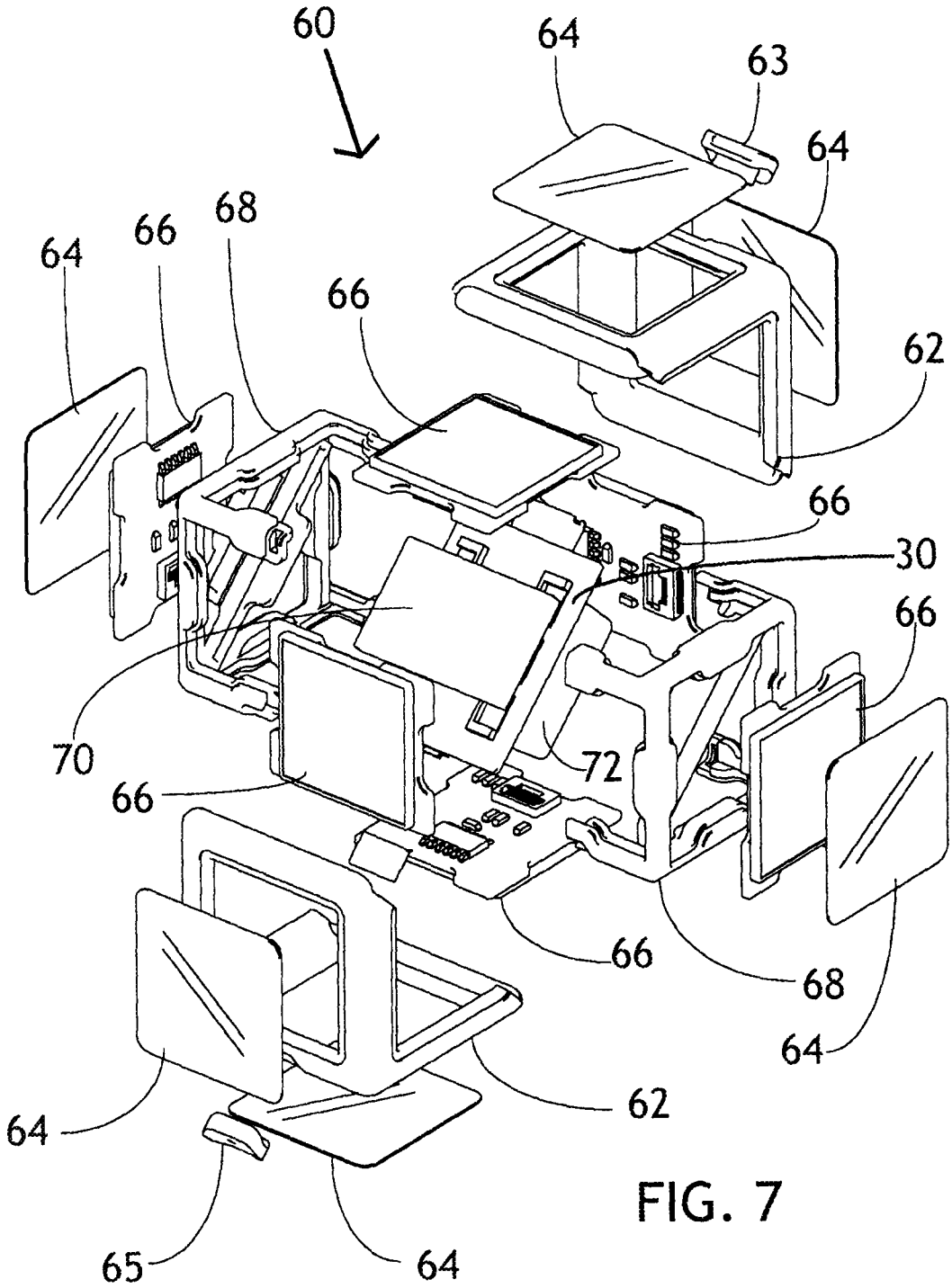
FIG. 7 is an exploded view of a 6-sided die.

Programming the die 60 may be accomplished by any means known in the art or later developed, such as by the wireless connection illustrated in FIG. 6. The connection may also be a physical wiring of the die 60 to a device such as a phone, tablet, or computer (collectively a "computer") 10. Likewise, charging the device may be accomplished through induction, hardwired charging, replacing batteries, or any other means known or later discovered. As shown in FIG. 7, the internal structure of the die 60 must be robust enough to withstand repeated rolling and dropping. To this end, roll cage 62 may be fitted over an internal cage 68, both supporting display windows 64 and a display monitor 66 behind said display windows 64 (together forming a "screen"). Within the internal cage should be a central processing core 30. The central processing core 30 should also provide a means of communication, such as a wireless transmitter or a physical port, so that the individual faces of die may be programmed. If a physical port is provided, a cover 63 should be provided. A battery 72, such as the one behind processing core 30, would also be included in the processing core 30, with whatever charging hardware would be needed, be it wireless induction or a physical connection. If a physical connection is provided, a single port may be used for both charging and communication. Buttons 65 may be provided for manual input. Also, a counterweight 70 or other structure may also be provided to help compensate for any uneven weight of the components and ensure fair rolling.

Figure 8:
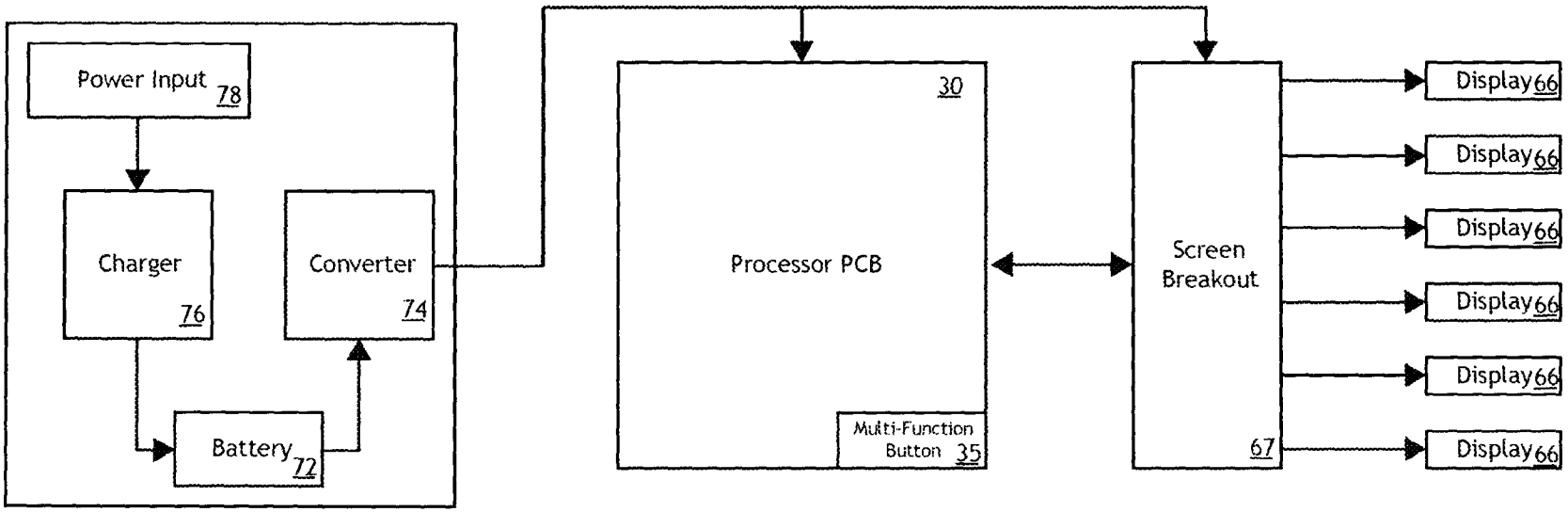
FIG. 8 is an electronic schematic for a 6-sided die.
Figure 9:
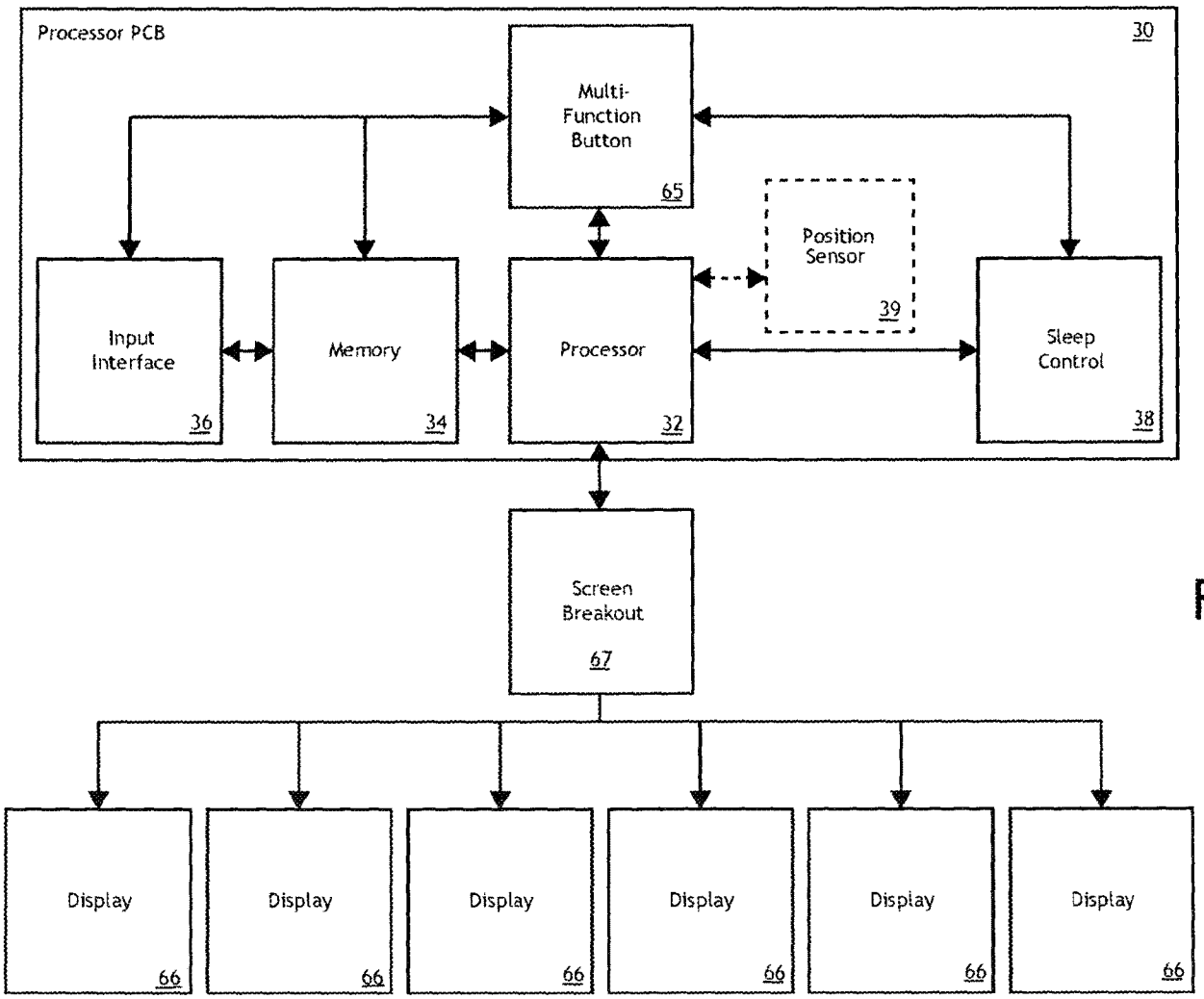
FIG. 9 is a more detailed schematic of the processor and display system of a 6-sided die.

The overall electronic structure of the die is shown schematically in FIG. 8. Power is provided through power input 78 and passed to a charger structure 76 which then allows power to be stored in battery 72. Power input 78 may be a USB power input or other port, or an inductor or any other source now known or later discovered. A converter 74 may be provided to allow acceptable power to be used with the central processing core 30 and individual displays 66. The central processing core 30 may present a CPU 32 and memory 34 for basic functionality. An input interface 36 allows communication with another device, such as a cellular phone or personal computer. The input interface may be of any type now known, such as but not being limited to a BLUETOOTH antenna or a physical USB port. If it is a physical port, it may also serve as a charging port. A multi-function button 65 may be provided to have direct input to the CPU 32. A sleep control circuit 34 may also be provided to conserve power stored in the battery. The CPU should then be connected to the displays 66, such as though a screen breakout 67. A position sensor 69, such as a gyroscope, accelerometer, or ambient light sensors may be provided to help the CPU 32 determine orientation. However, the basic functionality of the die will assign individual output displays to individual screens which will not change based on orientation. Neither does the die report roll data back to the computer. So, this addition is not necessary unless additional position related graphics, which will not change the overall display paradigm, are desired (such as having the "winning" screen flash or light up when all others are dark). Ambient light sensors (dashed lines, FIGS. 3 and 5) may be positioned proximate each screen, in the frame, or behind or in the screen in such a way to "see" through or around the screen (such as by having a small hole or cutout allowing the sensor access to the ambient environment). Essentially, when using ambient light sensors, the sensor which registers the least light for a predetermined amount of time would be the bottom face and serve as an identification of the top or winning face (which may be the bottom face on a 4-sided die).

Figure 10:
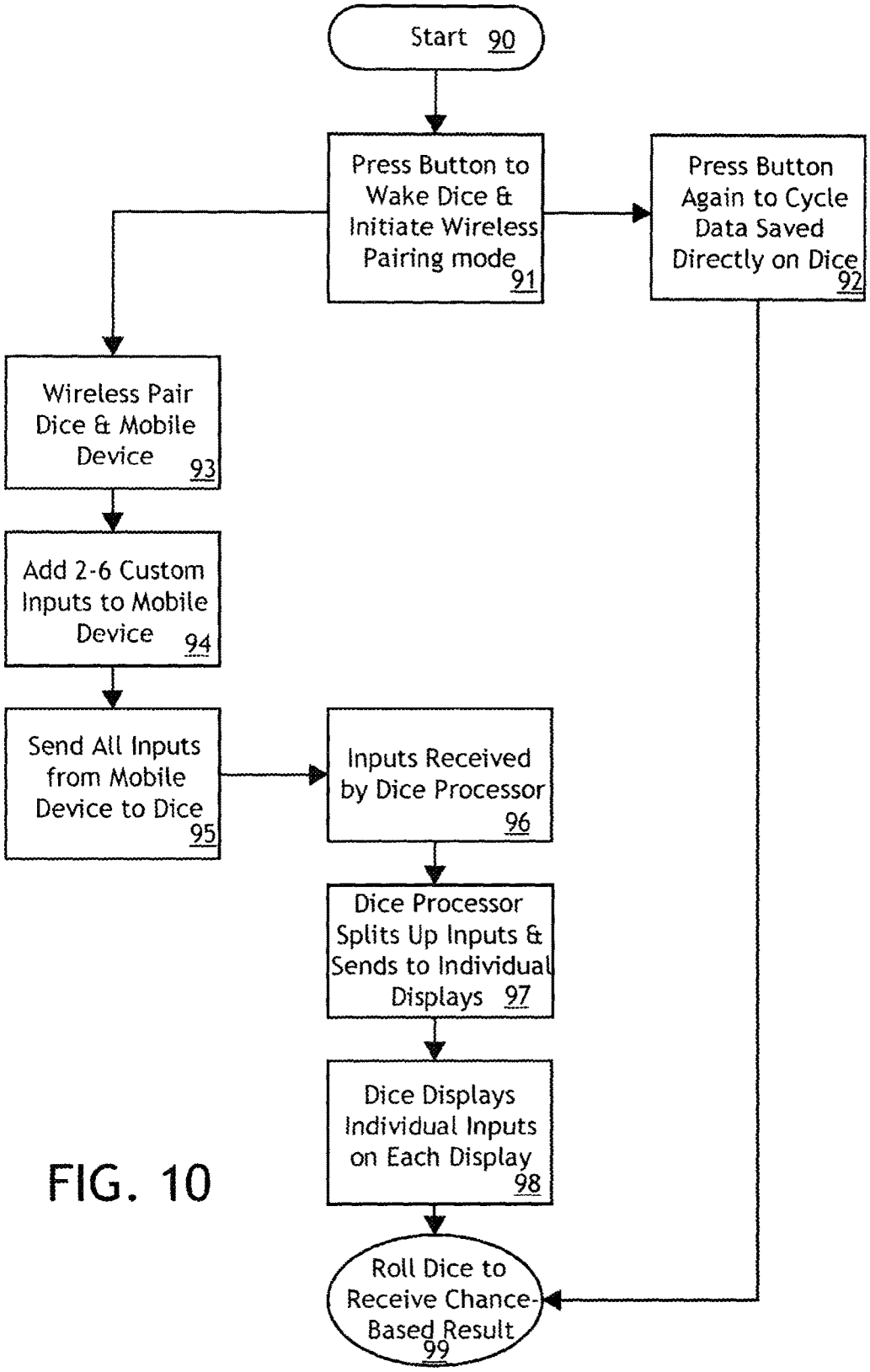
FIG. 10 is a method flowchart depicting operation for a 6-sided die.

Programming the die may be a straightforward process 90, such as illustrated in FIG. 10, beginning with waking the die up by pressing a button 91 or some other electronic signal. Since memory can be utilized to save some custom settings, the button or other input may direct to a menu which allows previously saved display paradigms to be utilized without control from another device 92. Otherwise, if not already paired, the die may be paired with another device 93 and custom inputs be made in a control program on the other device (2-6 such inputs for a 6-sided die) 94 which are then transmitted to the die 95. These inputs may then be received by the processing unit 96, split and sent to individual displays 97 as a display paradigm. The die then may display the inputs on each display 98 and then be used as determined by the user 99. It should be noted that when there are fewer inputs then displays, some inputs may be duplicated to be displayed on multiple screens or a "roll again" or some other result graphic may be utilized.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A programmable die comprising:

a polyhedral, internal roll cage formed of edges and defining an interior and an open, faceted exterior with a plurality of facets;

processing unit within the interior;

a memory operably connected to the processing unit;

a means for programming the processing unit;

an external roll cage fitting over and of a similar polyhedral shape as the internal roll cage, also being formed of edges with an open, faceted exterior;

a plurality of display screens, equal to the number of facets on the internal and external roll cages, said display screens at least partially disposed between said internal and external roll cages, said display screens occupying an entirety of a viewable area of each facet as defined by the edges of the external roll cage; and the processing unit providing user programmable output to be displayed on the display screens as a display paradigm, said paradigm not changing based on the position of the die.

2. The programmable die of claim 1, the means for programming the processing unit further comprising an antenna for communication with a computer and a resident application on said computer for selecting output displays.

3. The programmable die of claim 1, the means for programming the processing unit further comprising a data communications port and a computer with a resident application on said computer for selecting output displays.

4. The programmable die of claim 1, further comprising a position sensor.

5. The programmable die of claim 4, the position sensor being selected from the set of position sensors consisting of: at least one accelerometer and a gyroscope.

6. The programmable die of claim 1, the position sensor being at least one ambient light sensor positioned in each face of the die, wherein a sensor detecting a least amount of ambient light indicating a bottom face.

7. The programmable die of claim 1, the display screens being selected from the set of display screens consisting of electronic paper and liquid crystal display (LCD) screens.

8. The programmable die of claim 1, the memory storing at least one selectable prior configured display paradigm.

9. The programmable die of claim 1, further comprising a counterweight to ensure fair rolling.

10. The programmable die of claim 1, each screen being further comprised of a display monitor between the internal and external roll cages and a clear display window mounted on the external roll cage.

* * * * *